US007837351B2

(12) United States Patent
Lin

(10) Patent No.: US 7,837,351 B2
(45) Date of Patent: Nov. 23, 2010

(54) LUMINOUS ASSEMBLY HAVING A FIBER-FORMED SHAPED PART

(76) Inventor: Shu-Hung Lin, No. 39, Section 3, Zhonghua Road, Xinzhu City (TW)

( * ) Notice: Subject to any disclaimer, the term of this patent is extended or adjusted under 35 U.S.C. 154(b) by 0 days.

(21) Appl. No.: 11/766,835

(22) Filed: Jun. 22, 2007

(65) Prior Publication Data

US 2008/0192470 A1 Aug. 14, 2008

(30) Foreign Application Priority Data

Feb. 14, 2007 (CN) ..... 2007 2 0139542

(51) Int. Cl.
*F21S 4/00* (2006.01)
*F21V 21/00* (2006.01)

(52) U.S. Cl. ..... 362/249.02; 362/249.01; 362/249.06; 362/808; 362/124; 362/806; 362/363

(58) Field of Classification Search ..... 362/252, 362/249, 231, 240, 244, 246, 806–809, 565, 362/567, 122, 249.06, 249.14–249.17
See application file for complete search history.

(56) References Cited

U.S. PATENT DOCUMENTS 4,161,021 A * 7/1979 George, Jr. ..... 362/252
5,645,343 A * 7/1997 Rinehimer ..... 362/252
5,772,312 A * 6/1998 Pihl-Niederman et al. .. 362/249
6,401,404 B1 * 6/2002 Fillipp et al. ..... 52/80.1
6,443,595 B1 * 9/2002 Tseng ..... 362/250
6,474,843 B2 * 11/2002 Shieh ..... 362/252
6,497,497 B1 * 12/2002 Ahroni ..... 362/250
6,719,440 B1 4/2004 Wang
6,830,361 B2 12/2004 Wang
7,086,757 B2 * 8/2006 Wang ..... 362/249
7,290,900 B1 * 11/2007 Tsai ..... 362/252
2005/0047136 A1 * 3/2005 Fan ..... 362/252
2007/0032166 A1 * 2/2007 Wei ..... 446/331

* cited by examiner

*Primary Examiner*—Sandra L O'Shea
*Assistant Examiner*—Danielle Allen
(74) *Attorney, Agent, or Firm*—Fitch, Even, Tabin & Flannery

(57) ABSTRACT

The present invention provides a luminous assembly, more particularly, a decorative luminous assembly having a fiber-formed shaped part. The luminous assembly includes a light source and a shaped part of fiber with a predetermined shape. The light source is installed on the shaped part of fiber. The luminous assembly may further comprise a light reflecting element arranged in the back thereof. Light from the light source to the light reflecting element is reflected back substantially towards the shaped part. The luminous assembly has advantages of simple manufacturing process, lower cost, and convenience for mass production etc.

19 Claims, 6 Drawing Sheets

LUMINOUS ASSEMBLY HAVING A FIBER-FORMED SHAPED PART

STATEMENT OF RELATED APPLICATION

The present application claims the priority of the Chinese Patent Application No. 200720139542.2, filed on Feb. 14, 2007, entitled "lamp assembly with shaped part of filament", the disclosure of which is incorporated herein by reference.

BACKGROUND OF THE INVENTION

1. Field of the Invention

The present invention relates to a luminous assembly and, more particularly, to a decorative lamp assembly with a fiber-formed shaped part.

2. Discussion of the Related Art

During festivals such as Christmas, a decorative lamp string is often used. Sometimes, in order to build a special atmosphere, the decorative lamp string needs to be hanged on or wrapped around a shaped body or a shaped frame. For example, the decorative lamp string may be hanged on a Christmas tree. Alternatively, a shaped frame may be assembled by wooden poles, plastic poles or ferric poles, and then the decorative lamp string is hanged on the shaped frame.

At present, the cost of manufacturing a Christmas tree or a shaped frame is relatively high, and its manufacturing process is relatively complex. Therefore, it is generally not suitable for industrialized mass production. Further, because the Christmas trees or the shaped frames generally occupy a larger space, they can cause a higher transportation cost when a long-distance transportation is required.

Therefore, it is necessary to provide a decorative luminous assembly with a shaped part so as to overcome the above disadvantages.

SUMMARY OF THE INVENTION

An object of the present invention is to provide a luminous assembly with a shaped part. The shaped part has a simple manufacturing process and a lower cost, and is convenient for mass production.

The present invention realizes the above object by providing a luminous assembly, which includes a lamp string and a shaped part of fiber. The lamp string has a number of point light sources. The shaped part of fiber may have a predetermined shape. The lamp string is installed on the shaped part of fiber.

In accordance with an aspect of the invention, the shaped part of fiber includes a housing formed of interlaced light refracting fibers. The housing defines a number of openings and an acceptance space therein. The acceptance space communicates with the environment via the openings.

In accordance with another aspect of the invention, the lamp string is hanged in the acceptance space, and the number of point light sources are distributed in the acceptance space essentially uniformly.

In accordance with another aspect of the invention, the shape of the shaped part of fiber may be selected from the group consisting of: Santa Claus, snowman, globoid, cube, combined cube, cartoon personage, and animal.

In accordance with yet another aspect of the invention, the decorative luminous assembly further includes a light reflecting element arranged in the back thereof. The light reflecting element and the interlaced light refracting fiber are combined together to form the acceptance space.

In accordance with yet another aspect of the invention, the light reflecting element may be selected from the group consisting of laser sequin, seven-colored sequin, magic-colored sequin or reflector.

In accordance with still another aspect of the invention, a surface of the light reflecting element facing the acceptance space is coated with blinking gold dust and/or pearl powder.

In accordance with still another aspect of the invention, the point light source of the lamp string is an incandescent lamp.

In accordance with still another aspect of the invention, the point light source of the lamp string is a light emitting diode.

According to the luminous assembly of the present invention, it is known that the lamp string is enclosed in the acceptance space of the shaped part of fiber, and the shaped part of fiber is made of at least one fiber with light refracting, light scattering, light reflecting and/or light transmitting properties. Consequently, while the lamp string is working, the light emitted therefrom partially travels through the openings of the housing, while the remainder is refracted, reflected and/or transmitted by the fiber to form multicolored light to be finally emitted. If the lamp string works flickeringly, a multicolored and dazzling effect can be added.

When the light reflecting element is arranged at one side of the shaped part of fiber, light emitted from the light source of the lamp string and transmitted towards the light reflecting element can be essentially reflected back. Thus, the brightness at that side of the decorative luminous assembly can be enhanced. Further, prismy multicolored light may be formed via a special surface configuration of the light reflecting element.

In addition, because the shaped part of fiber of the present invention may be made of a plastic material and manufactured using a wire drawing machine, the material cost thereof is lower, the manufacturing process thereof is simpler, and thereby it is suitable for industrialized mass production.

Other and further objects of the invention will be apparent from the following drawings and description of preferred embodiments of the invention in which like reference numerals are used to indicate like parts in the various views.

BRIEF DESCRIPTION OF THE DRAWINGS

Many aspects of the present luminous assembly can be better understood with reference to the following drawings. The components in the drawings are not necessarily drawn to scale, the emphasis instead being placed upon clearly illustrating the principles of the present luminous assembly. Moreover, in the drawings, like reference numerals designate corresponding parts throughout the several views.

DESCRIPTION OF THE PREFERRED EMBODIMENTS

Reference will now be made to the figures to describe the present invention in detail.

Figure 1:
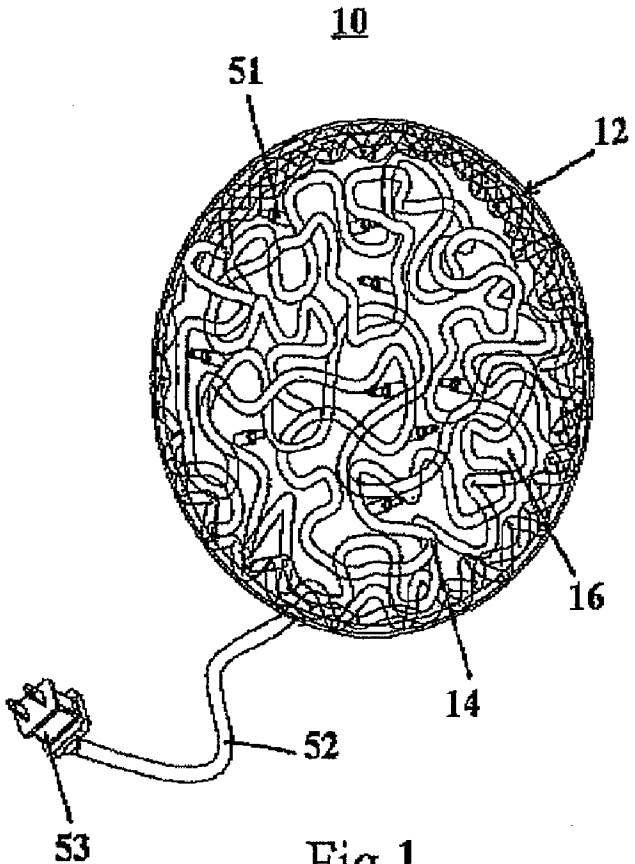
FIG. 1 is an isometric, schematic view of a luminous assembly with a shaped part of fiber in accordance with the first preferred embodiment of the present invention.
Figure 2:
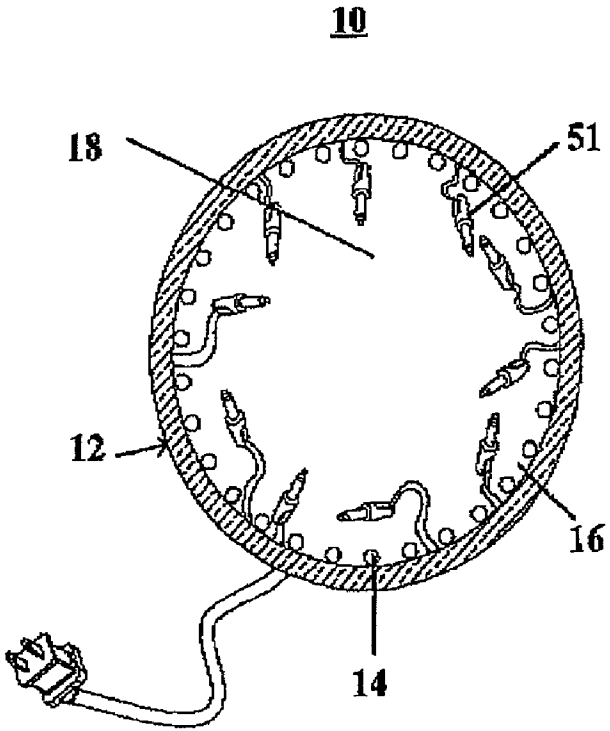
FIG. 2 is a cross sectional, schematic view of the luminous assembly with a shaped part of fiber shown in FIG. 1.
Figure 7:
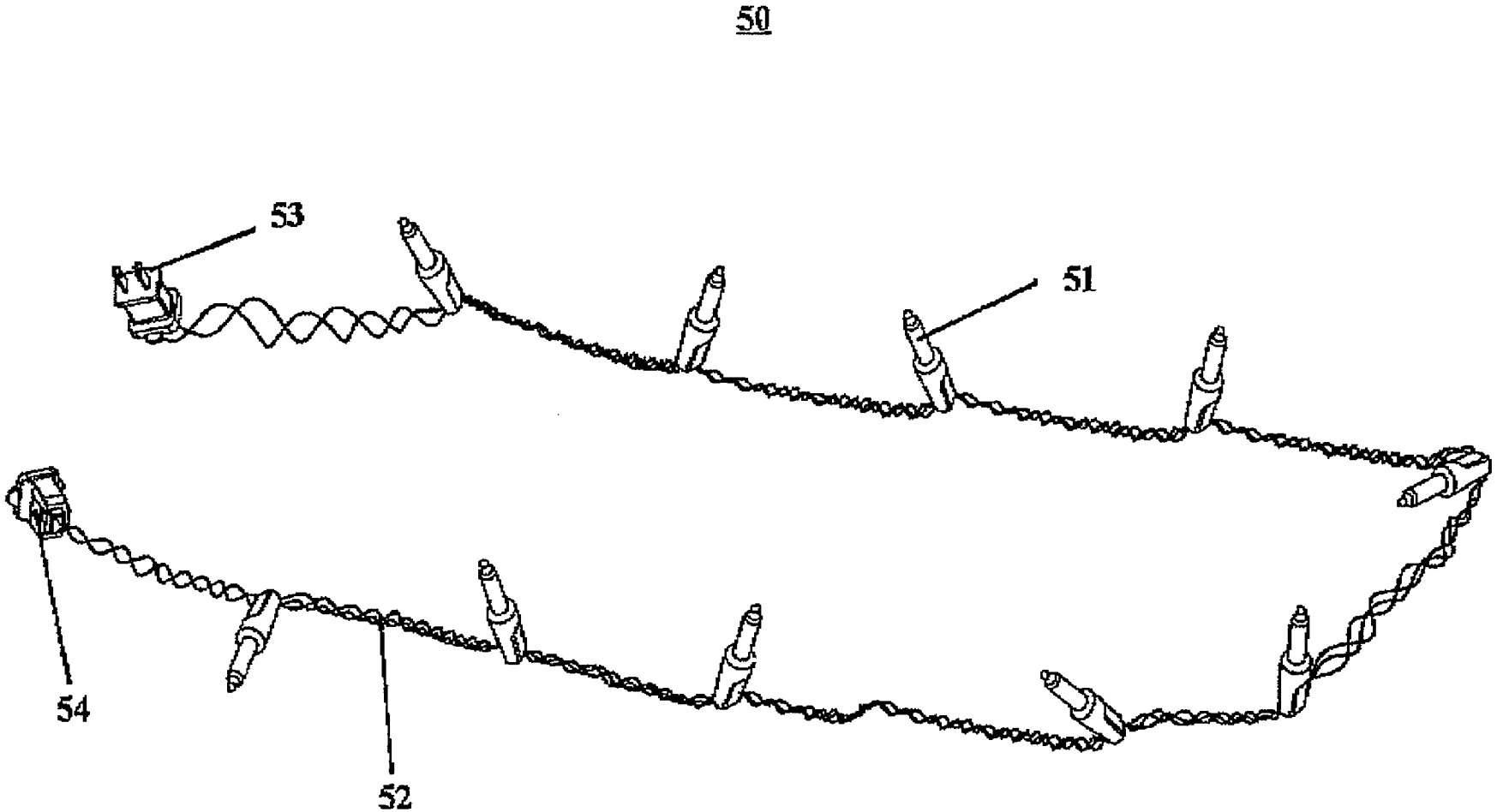
FIG. 7 is an isometric, schematic view of a lamp string used in the present invention.

Referring to FIGS. 1, 2 and 7, a luminous assembly 10 with a shaped part of fiber in accordance with the first preferred embodiment of the present invention is shown in FIGS. 1 and 2, and a lamp string 50 used in the decorative luminous assembly 10 is shown in FIG. 7. The decorative luminous assembly 10 includes the lamp string 50 and a spherical shaped part of fiber (not labeled). The lamp string 50 is installed within the shaped part of fiber.

Figure 8:
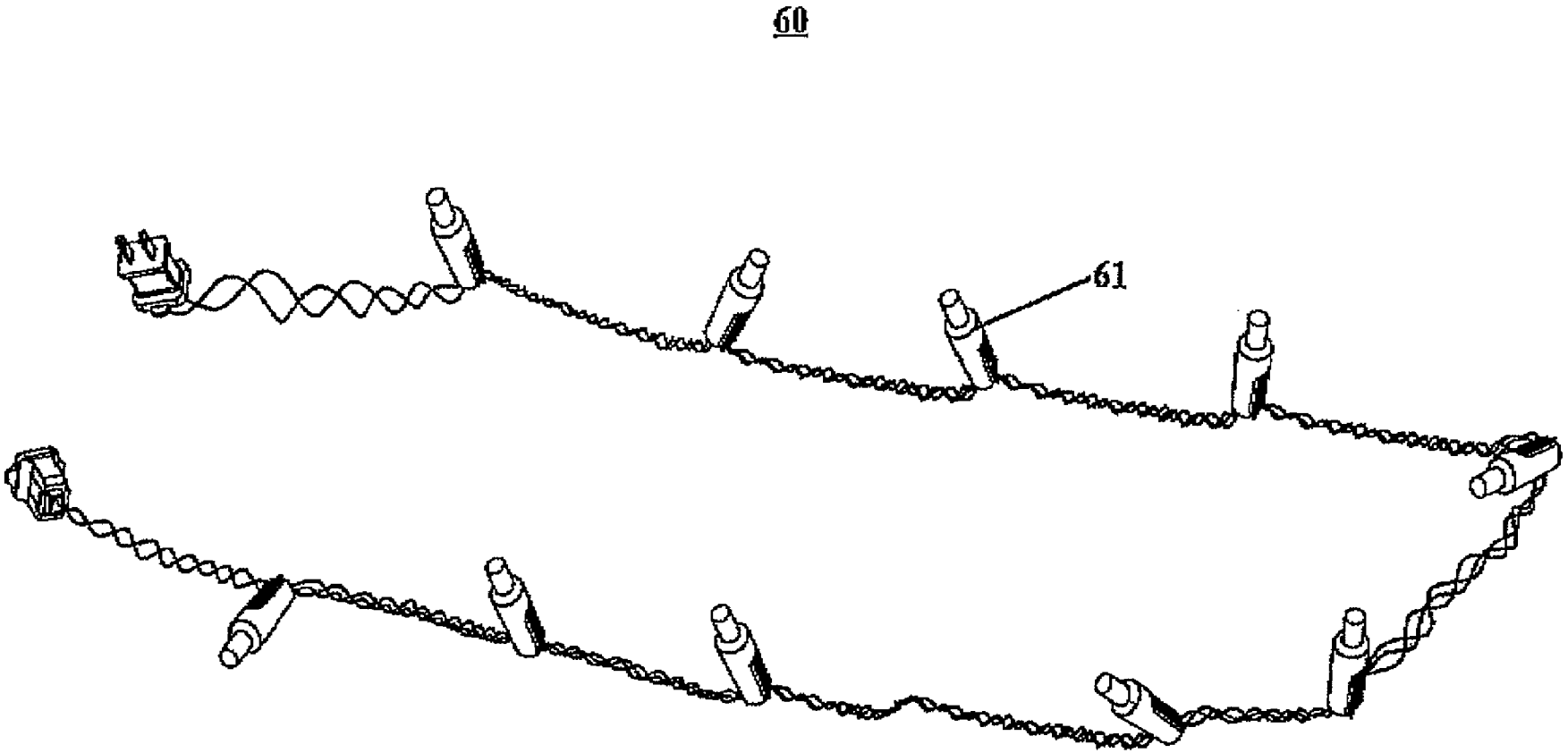
FIG. 8 is an isometric, schematic view of another lamp string used in the present invention.

Specifically, referring to FIG. 7, the lamp string 50 includes an electric wire 52 and a number of point light sources 51 connected (in series or in parallel) by the electric wire 52. The lamp string 50 also includes a plug 53 set at one end thereof and used for connecting a power source. The lamp string 50 optionally includes a tail plug 54 set at another end thereof. The tail plug 54 functions as a socket so that a plug of the next lamp string can be inserted in the tail plug of the immediately preceding lamp string, if two or more lamp strings need to be connected. Therefore, a lamp string is electrically connected to the lamp string next to it, whereby lamp strings may be lighted simultaneously. In this embodiment, the point light sources 51 of the lamp string 50 are an incandescent lamp. The incandescent lamp has a glower for being heated to incandescence by an electric current. Alternatively, the present invention may adopt a light emitting diode (LED) as its point light source. Referring to FIG. 8, a lamp string 60 with a number of point light sources 61 is shown. The lamp string 60 is essentially similar to the lamp string 50 shown in FIG. 7. The difference therebetween is that the point light sources 61 are a light emitting diode. As the light emitting diode is a cold-light light source, and has the virtue of long lifespan, low power consumption etc., it is widely used in the field of illumination. Of course, other kinds of light source known in the art may also be used.

Referring to FIGS. 1 and 2, the spherical shaped part of fiber includes a housing 12 formed of interlaced light refracting fibers 14. The housing 12 defines a number of openings 16 and an acceptance space 18 therein. The acceptance space 18 communicates with the environment via the openings 16.

The spherical shaped part of fiber may be produced by the following manufacturing process. Firstly, a hemispherical mold is prepared. Secondly, polypropylene, polyethylene or polyvinyl chloride (PVC) is used as the raw material, which is heated, extruded and stretched sequentially by a commercially available wire drawing machine so as to form the round or flat fiber 14. Thirdly, the fibers 14 are braided on the hemispherical mold using a commercially available warp knitting machine or circular knitting machine. Fourthly, the mold is removed and a hemispherical shaped part of fiber is attained after cooling. Finally, two hemispherical shaped parts of fiber are interfaced with their concave surfaces being opposite. That is how the spherical shaped part of fiber is formed. It bears mentioning that no particular limitations are imposed on the knitting manner of the fiber 14. In other words, the knitting manner may be random and irregular, or alternatively regular so as to form, for example, a number of lattice squares, cordates, etc.

Of course, the above-mentioned method is only one of the possible manufacturing methods of the shaped part of fiber of the present invention. Other manufacturing methods known in the art may also be used. The shaped part of fiber made of the selected material in accordance with the present embodiment has certain light refracting property. Further, other ingredients may be added in the selected material to enhance heat resistance, toughness, ductility, oxidation resistance etc. A light reflecting and light scattering material, such as pearl powder etc., can also be added to enhance the light reflecting and light scattering property of the shaped part of fiber.

An assembling process of the present luminous assembly 10 includes the following steps. Firstly, the lamp string 50 is piecewise bound on or sticks to corresponding segments of the fiber 14 using thin lines (not shown) or adhesive tape (not shown). Secondly, two hemispherical shaped parts of fiber are interfaced to form the luminous assembly 10. The interfacing manner may be any connection manners known in the art, such as binding using lines or sticking using adhesive tape.

FIG. 2 shows a cross sectional, schematic view of the luminous assembly 10 with a shaped part of fiber. A number of point light sources 51 are distributed in the acceptance space 18 essentially uniformly, so that uniform and dazzling light is formed in the acceptance space 18. Of course, the number of point light sources 51 may also be distributed uneven in the acceptance space 18, if desired.

According to the decorative luminous assembly 10 of this embodiment, it is known that the lamp string 50 is enclosed in the acceptance space 18 of the shaped part of fiber, and the snowball-like shaped part is made of at least one fiber with light refracting, light scattering, light reflecting and/or light transmitting properties. While the lamp string 50 is working, the light emitted therefrom travels directly through the openings 16 of the housing 12, while the remainder is refracted, reflected and/or transmitted by the fiber to form multicolored light to be finally emitted. If the lamp string 50 works flickeringly, a multicolored and dazzling effect can be added. In addition, because the shaped part of fiber of the present invention may be made of a plastic material and manufactured using a wire drawing machine, it is suitable for industrialized mass production.

Figure 3:
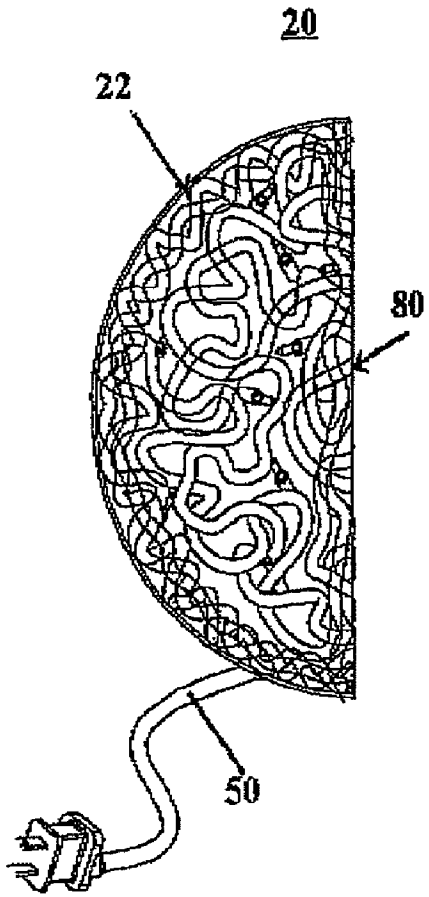
FIG. 3 is a side view of a luminous assembly with a shaped part of fiber in accordance with the second preferred embodiment of the present invention.

Referring to FIG. 3, a luminous assembly 20 with a shaped part of fiber in accordance with the second preferred embodiment of the present invention is shown. The decorative luminous assembly 20 is essentially similar to the decorative luminous assembly 10 shown in FIG. 1. The similar portions are not described herein. The difference therebetween is described as follows. The decorative luminous assembly 20 presents a hemispherical shape as a whole. In addition to a hemispherical shaped part of fiber, the housing 22 of the assembly further includes a light reflecting element 80 arranged in the back of the shaped part. The term "back" herein means a position close to the concave camber of the hemispherical shaped part. The light reflecting element 80 and the interlaced light refracting fiber are combined together to form the acceptance space (not labeled) of the decorative luminous assembly 20. The combination manner may be any connection manners known in the art, such as binding using lines or sticking using adhesive tape etc. The light reflecting element 80 may adopt a laser sequin, seven-colored sequin, magic-colored sequin or a reflector, or any combination thereof. Further, the surface of the light reflecting element facing the acceptance space may be coated with blinking gold dust and/or pearl powder. In this way, when the lamp string 50 is working in the decorative luminous assembly 20, the light emitted from the light source of the lamp string 50 and transmitted towards the light reflecting element can be essentially reflected back. Thus, the brightness at the foreside of the decorative luminous assembly can be enhanced. Further, prismy multicolored light may be formed.

The decorative luminous assembly 20 in accordance with the second preferred embodiment of the present invention is especially useful in the situation where the decorative luminous assembly 20 always faces towards only one direction. In use, the foreside of the decorative luminous assembly 20 may face towards the direction on which people tend to focus their attentions, while the backside of the decorative luminous assembly 20 may face towards another direction, which is less concentrative. Another virtue of the decorative luminous assembly 20 lies in the convenience in transportation, because its size is essentially reduced to half relative to the decorative luminous assembly 10 in FIG. 1.

Figure 4:
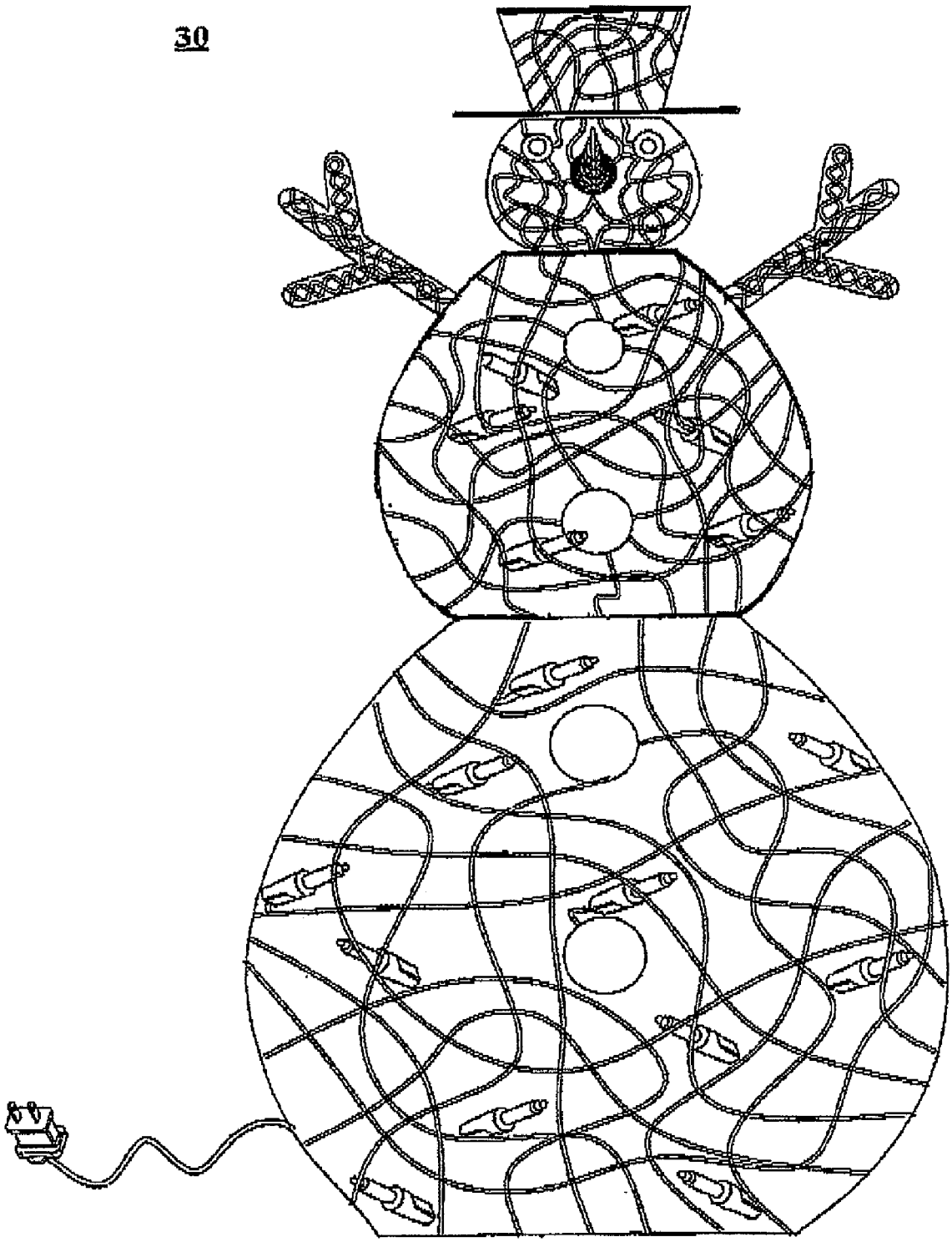
FIG. 4 is an isometric, schematic view of a luminous assembly with a shaped part of fiber in accordance with the third preferred embodiment of the present invention.
Figure 5:
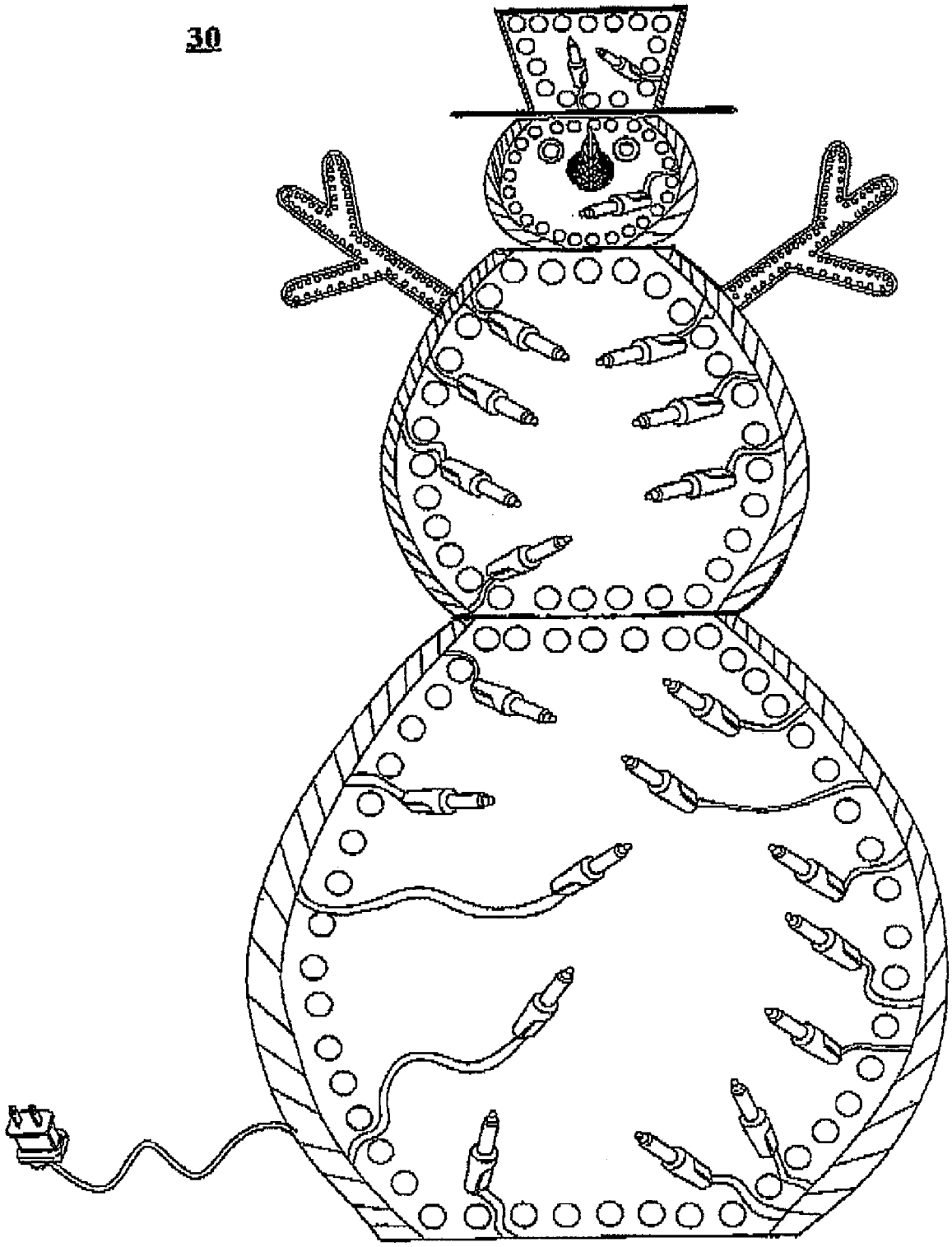
FIG. 5 is a cross sectional, schematic view of the luminous assembly with a shaped part of fiber shown in FIG. 4.

FIGS. 4 and 5 show a luminous assembly 30 with a shaped part of fiber in accordance with the third preferred embodiment of the present invention. The decorative luminous assembly 30 is essentially similar to the decorative luminous assembly 10 shown in FIG. 1. The similar portions are not described herein. The difference therebetween is described as follows. The decorative luminous assembly 30 in a snowman shape includes an upper body, a lower body, a head, arms, a nose and wears a cap and clothes (not labeled) etc., so as to give a more real image. During manufacturing, the upper body, the lower body, the head, the arms and so on may be formed separately and then assembled together. Of course, the shaped part of fiber may be alternatively formed of two parts similarly to the first embodiment.

Figure 6:
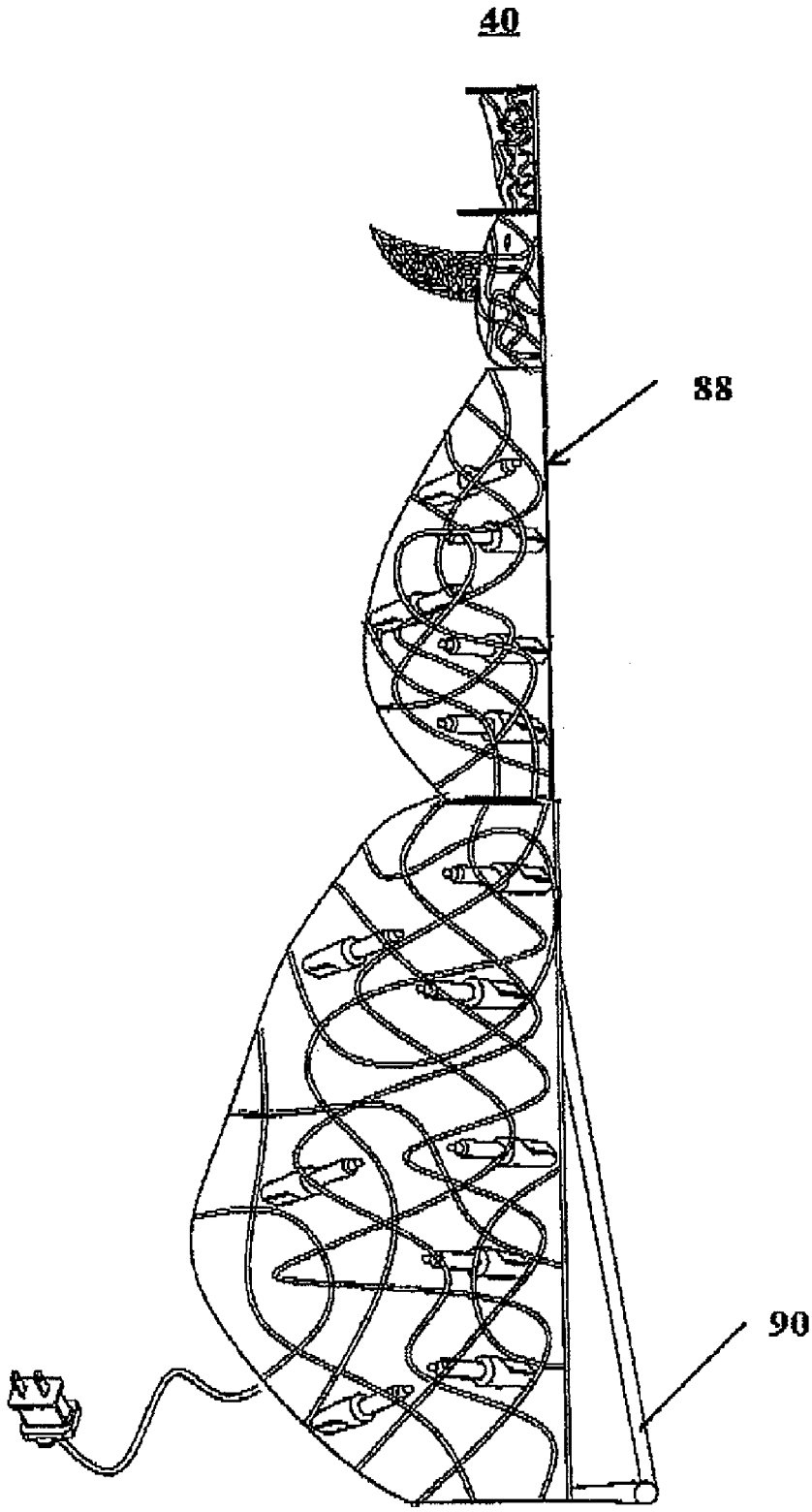
FIG. 6 is a side view of a luminous assembly with a shaped part of fiber in accordance with the fourth preferred embodiment of the present invention.

Referring to FIG. 6, a luminous assembly 40 with a shaped part of fiber in accordance with the fourth preferred embodiment of the present invention is shown. The decorative luminous assembly 40 is essentially similar to the decorative luminous assembly 20 in FIG. 3. The similar portions are not described herein. The difference therebetween is described as follows. The decorative luminous assembly 40 presents a half snowman in shape, so its light reflecting element 88 varies accordingly. The light reflecting element 88 not only reflects light, but also scatters light. A support bracket may be additionally arranged at the back of the decorative luminous assembly 40 so as to facilitate the location of the decorative luminous assembly 40.

Various preferred embodiments have been described with reference to the accompanying figures. However, it will be apparent to those skilled in the art that various modifications and variations may be made in the method and system of the present invention without departing from the spirit or scope of the invention. For example, the shaped part of fiber may also be selected from following models: Santa Claus, cube, combined cube, cartoon personage, and animal. Furthermore, in stead of the lamp string, independent light bulb may also be used as light source. Thus, it is intended that the present invention includes modifications and variations that are within the scope of the appended claims and their equivalents.

What is claimed is:

1. A luminous assembly, comprising:

a frameless shaped part entirely composed of at least one light refracting fiber interlaced in a random and irregular manner and adapted to form a frameless housing of a predetermined shape, and a light source attached to the fiber of the frameless housing.

2. The luminous assembly as claimed in claim 1, wherein the light source comprises a lamp string with a plurality of point light sources.

3. The luminous assembly as claimed in claim 2, wherein the frameless housing defines an acceptance space enclosed within the housing, the acceptance space communicating with the environment via a plurality of openings defined by the interlaced light refracting fiber.

4. The luminous assembly as claimed in claim 3, wherein the lamp string is disposed in the acceptance space, and the plurality of point light sources are distributed in the acceptance space essentially uniformly.

5. The luminous assembly as claimed in claim 4, wherein the shape of the shaped part may be selected from the group consisting of: Santa Claus, snowman, globoid, cube, combined cube, cartoon personage, and animal.

6. The luminous assembly as claimed in claim 1, wherein the shaped part comprises a substantially planar back side with a light reflecting element coupled to and completely covering the back side of the shaped part, and wherein the light reflecting element in combination with the interlaced light refracting fiber of the housing form an acceptance space, and the incident light to the light reflecting element is reflected back substantially towards the shaped part.

7. The luminous assembly as claimed in claim 6, wherein the light reflecting element is selected from the group consisting of laser sequin, seven-colored sequin, magic-colored sequin and reflector.

8. The luminous assembly as claimed in claim 6, wherein a surface of the light reflecting element facing towards the acceptance space is coated with blinking gold dust or pearl powder.

9. The luminous assembly as claimed in claim 7, wherein the point light sources of the lamp string are incandescent lamps.

10. The luminous assembly as claimed in claim 8, wherein the point light sources of the lamp string are light emitting diodes.

11. A luminous assembly, comprising:

a frameless shaped part entirely composed of a fiber of light refracting material, the fiber being interlaced in a random and irregular manner and adapted to create a desired shape; and a plurality of lighting elements spaced within the shaped part and coupled to the fiber of the shaped part, such that some of the light from the lighting elements is refracted as it exits the shaped part, creating a desired lighting effect.

12. A luminous assembly, comprising:

a frameless shaped part entirely composed of a light refracting fiber interlaced in a random and irregular manner and adapted to create a desired shape, wherein the fiber is formed of a plastic composition having at least one of light refracting, light reflecting and light transmitting properties; and a plurality of lighting elements connected to the fiber of the shaped part and spaced about at least a portion of the shaped part, such that one portion of the light from the lighting elements is refracted by the fiber, and another portion is scattered or transmitted, as it comes across the shaped part, creating a desired lighting effect.

13. The luminous assembly as claimed in claim 12, wherein blinking gold dust or pearl powder are added into the plastic composition.

14. The luminous assembly as claimed in claim 12, further comprising a light reflecting element coupled to a substantially planar back side of the shaped part, and completely covering the back side of the shaped part, wherein the light reflecting element and the interlaced light refracting fiber are combined to form an acceptance space, and the incident light to the light reflecting element is reflected back substantially towards the shaped part.

15. The luminous assembly of claim 1, wherein the fiber has a round cross-section.

16. The luminous assembly of claim 1, wherein the fiber has a flat cross-section.

17. The luminous assembly of claim 1, wherein the light refracting fiber is formed of a plastic composition.

18. The luminous assembly of claim 17, wherein the plastic composition has at least one of light refracting, light reflecting and light transmitting properties.

19. The luminous assembly of claim 17, wherein the light refracting fiber is manufactured using a wire drawing machine.

* * * * *